United States Patent [19]

Sansone et al.

[11] Patent Number: 4,998,204

[45] Date of Patent: Mar. 5, 1991

[54] MAILING SYSTEM AND METHOD FOR LOW VOLUME MAILERS PRINTING POSTAGE INFORMATION UPON INSERTS

[75] Inventors: Ronald P. Sansone, Weston; Michael P. Taylor, Norwalk, both of Conn.; Richard A. Connell, South Salem, N.Y.

[73] Assignee: Pitney Bowes Inc., Stamford, Conn.

[21] Appl. No.: 940,112

[22] Filed: Dec. 10, 1986

Related U.S. Application Data

[63] Continuation-in-part of Ser. No. 813,445, Dec. 26, 1985, Pat. No. 4,962,454.

[51] Int. Cl.[5] ..... G07B 17/00

[52] U.S. Cl. ..... 364/464.02

[58] Field of Search ..... 364/478, 466, 464.01, 364/464.02, 464.03, 401, 406; 235/495; 53/266 A

[56] References Cited

U.S. PATENT DOCUMENTS

| | | | |
|---|---|---|---|
| Re. 31,875 | 4/1985 | Check, Jr. et al. | 364/900 |
| 3,978,457 | 8/1976 | Check, Jr. et al. | 364/200 |
| 4,301,507 | 11/1981 | Soderberg et al. | 364/900 |
| 4,308,579 | 12/1981 | Dlugos | 364/200 |
| 4,319,328 | 3/1982 | Eggert | 364/466 |
| 4,578,759 | 3/1986 | Horii | 364/478 |
| 4,584,648 | 4/1986 | Dlugos | 364/466 |
| 4,639,873 | 1/1987 | Baggarly et al. | 364/478 |
| 4,713,761 | 12/1987 | Sharpe et al. | 364/406 |
| 4,734,865 | 3/1988 | Scullion et al. | 364/478 |

*Primary Examiner*—Parshotam S. Lall
*Assistant Examiner*—S. A. Melnick
*Attorney, Agent, or Firm*—Peter Vrahotes; David E. Pitchenik; Melvin J. Scolnick

[57] ABSTRACT

A system for processing batch mail in which the need for on-site inspection is unnecessary. The mail sender purchases postage from a central station thereby authorizing him to send mail equal to the amount of postage purchased.

The mail sender processes batches of mail each of which is accompanied by a statement summarizing the type and number of mail pieces sent and amount of postage for each batch. The 10 statement contains data that allows mail payment verification.

11 Claims, 7 Drawing Sheets

MAILING SYSTEM AND METHOD FOR LOW VOLUME MAILERS PRINTING POSTAGE INFORMATION UPON INSERTS

RELATED CASES

This application is a continuation-in-part application of copending application Ser. No. 813,445 filed Dec. 26, 1985 now U.S. Pat. No. 4,962,454.

BACKGROUND OF THE INVENTION

There are generally two ways in which commercial mail senders apply postage to their mail. The most common way is by use of a postage meter which is leased by the mailer from a postage meter manufacturer with which the amount of postage required is applied to each mail piece. Inserter systems have been developed whereby inserts may be placed into an envelope, the envelope may be sealed, addressed and have a postage indicia applied thereto. The mail pieces may be weighed on the fly or individual weighing may not be required if all the mail pieces are of like kind, i.e., only a sample mail piece need be weighed. These acts of processing mail, usually on a periodic basis, may be performed at a relatively high rate of speed.

A second method of mailing large quantities of mail pieces is the permit mail system. In such a system, the mail sender places a permit number on the mail pieces and prepares a manifest listing that shows the type and number of mail pieces being mailed on each occasion and the postage required.

With both systems, inspection at the site of the mail sender is required. In the case of the postage meter, the lessor of the postage meter, i.e., the postage meter manufacturer, is required by law to inspect the postage meter at least twice a year to ensure that there is no evidence of tampering with the postage meter that will indicate an attempt to obtain unauthorized postage. In the case of permit mail, large quantities of the same type of mail will be mailed at one time and the postal service will conduct an inspection to verify that the manifest listing accompanying the permit mail accurately accounts for the amount of postage due for the mail that has been processed by the postal service. This is accomplished through an inspection on the part of the postal service by examining the records of the mail user on every occasion.

Obviously, each of these two systems has certain drawbacks. In the case of on-site inspection of postage meters, with the large number of postage meters in use by large mail senders it is an expensive matter for the inspect thereof. Furthermore, postage meters that process large quantities of mail must be replaced relatively frequently because of wear. With regard to the permit mail system, the shortcoming lies in the need of the postal service to send a representative frequently to the various mail sender locations to ensure that the mail sender is accurately accounting for the quantity of mail being sent. Such a scheme is not totally reliable as it relies upon on-site verification using the mail senders records which are not secure.

SUMMARY AND OBJECTS OF THE INVENTION

A system has been conceived whereby a mail sender will be able to send batches of mail in a fast and convenient manner. This is accomplished by the mail sender having a secure accounting unit similar to a postage meter wherein postage value is placed by a dispensing, or central, station. A statement accompanies each batch of mail sent to a post office containing information relative to the mail and the amount of postage required. Communication between the central station and the mail sender allows postage value to be transferred to the mail user by the central station and postage and verification data is sent to the central station from the mail sender. The postage and verification data will be the same as that contained on the mailing statements that accompany the batches of mail. This system provides a central station for a large number of mail senders that acts as a clearing house for the postal service through whom verification of postage can be conveniently and inexpensively achieved.

Another feature of this invention is that the security features of a postage meter are provided while allowing a printer to be used for printing the mail pieces that is selectable by the mail sender.

A further feature of this invention is that a single printer may be used to print postage and mailing information on a mail piece and postage and verification information on a statement sheet that accompanies the batch of mail sent to the post office by a mail sender.

DETAILED DESCRIPTION OF THE PREFERRED EMBODIMENTS

Figure 1:
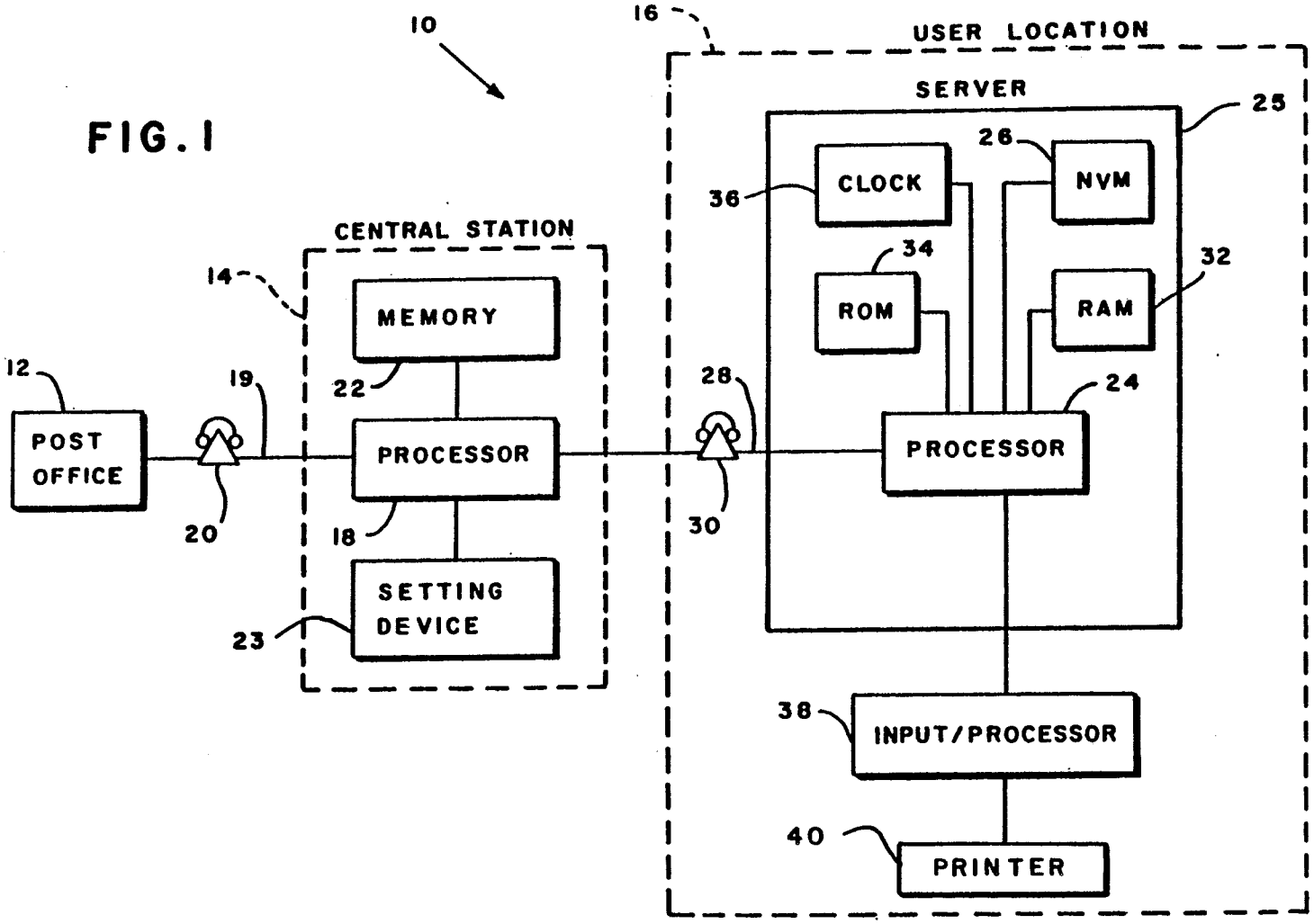
FIG. 1 is a block diagram of a batch mailing system.

Referring now to FIG. 1, a general description of a batch mailing system is shown generally at 10 and includes a post office 12, a central station 14 and a user location 16. The central station 14 has a processor 18. This processor 18 could be a main frame type of computer having substantial capacity.

Communication is provided between the post office 12 and a plurality of central stations 14 (only one being shown) through a line or communication link 19 having a communication device, such as a telephone 20, therein.

Associated with the processor 18 and in connection therewith is a large storage memory unit 22 where large amounts of data can be stored and a register setting device 23 that includes software of the type required in the resetting of postage meters remotely. Systems for the resetting of meters remotely are well known, see for example U.S. Pat. Nos. 3,792,446, 4,097,923 and 4,447,890.

A remote user location 16 has a secure unit 25 to which the user will have no access and will hereinafter be referred to as a "server". The server 25 is supplied by the central station 14 to the user and includes a user processor 24 that may be a processor of much smaller capacity. Connected to the processor 24 is a memory 26, preferably, a non-volatile memory (NVM). The user processor 24 is connected to the central station processor 18 through a communication link or line 28. A telephone 30 or other communicating device may be disposed within the line 28 to thereby provide selective communication between the processors 18, 24. Also connected to the processor 24 are a RAM 32, a ROM 34, and a clock 36 whose respective functions will be described in detail hereinafter.

An input/processor 38 is connected to the user processor 24 whereby data may be supplied, either manually or through a medium such as a disc or tape, to the user processor for the purpose of providing data required in the processing of mail pieces. The input/processor 38 may be any of a large number of personal computers having keyboard and display that are commercially available, such as an IBM XT personal computer.

A printer 40 is in communication with the Input/Processor 38 and is able to print upon mail pieces such as envelopes containing inserts. Preferably the printer 40 will print the data upon an insert, including the address block. The printed insert would then be placed within a windowed envelope with the address block visible. This printer 40 is one provided by the user and may be a high speed printer or have other characteristics desirable to the mailer.

The printer 40 is also capable of printing upon a statement sheet 46 or other document that contains information relative to the batch of mail being posted to the post office. Throughout the balance of the specification and claims this statement sheet 46 will be referred to as a "passport". Details of the passport 46 will be described hereinafter in conjunction with FIG. 2.

Although only one user location 16 is shown and described, it will be appreciated that many user locations can be serviced by the one central station 14. The central station 14 may be the location of a postage meter manufacturer or other accountable organization.

Figure 6:
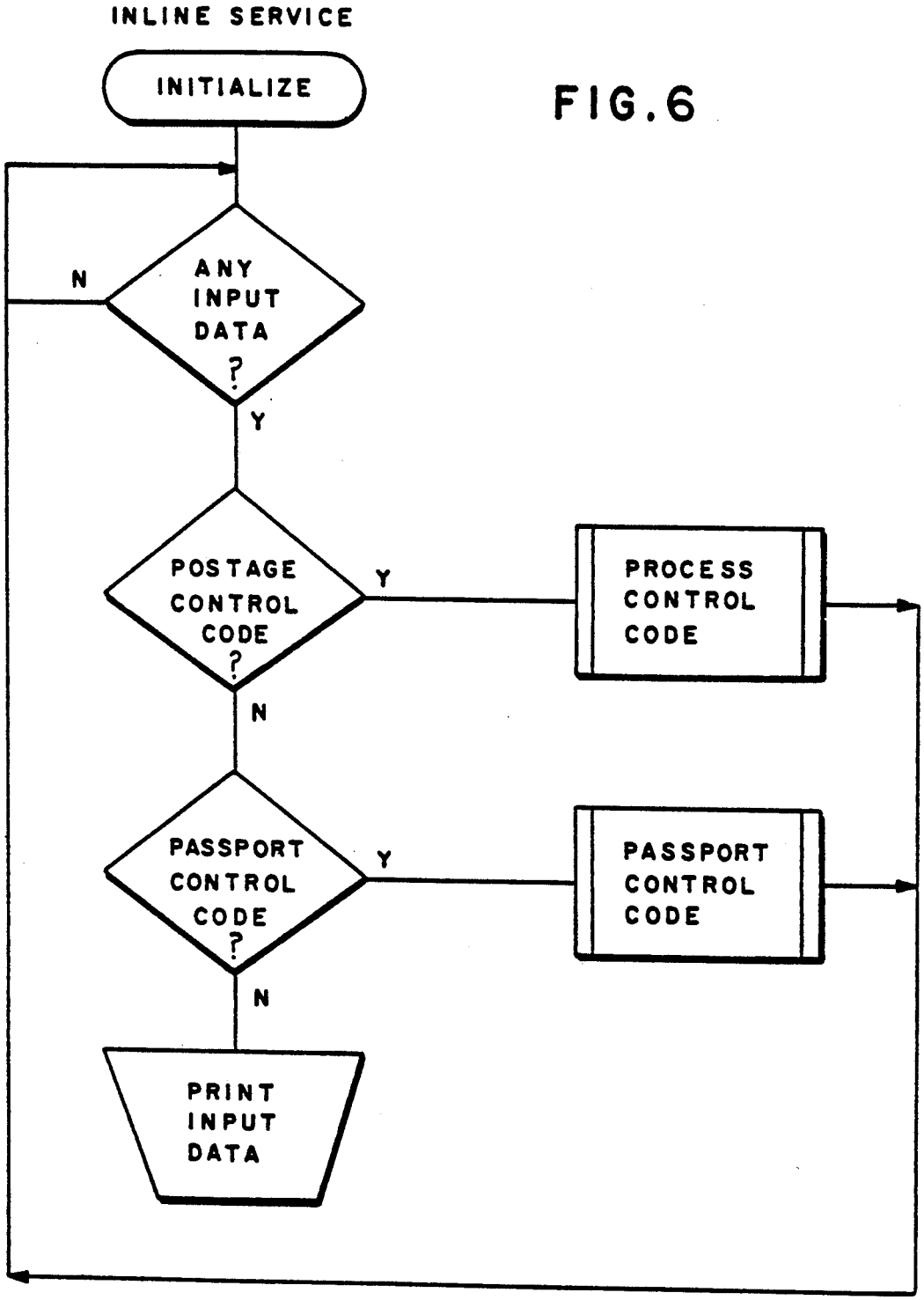
FIGS. 6–8 contain flow diagrams that describe the functions of the system shown in FIG. 1.
Figure 7:
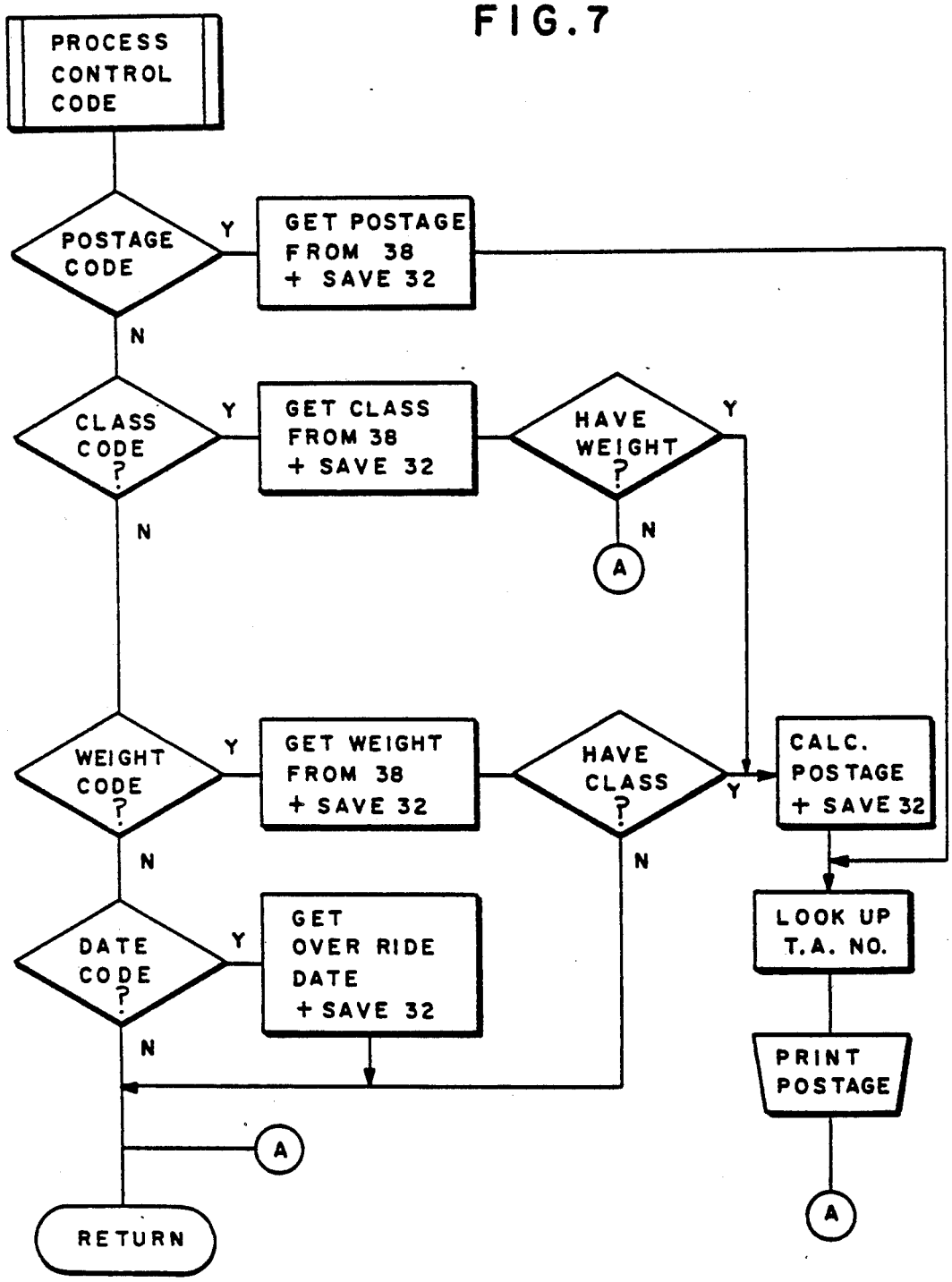
Figure 8:
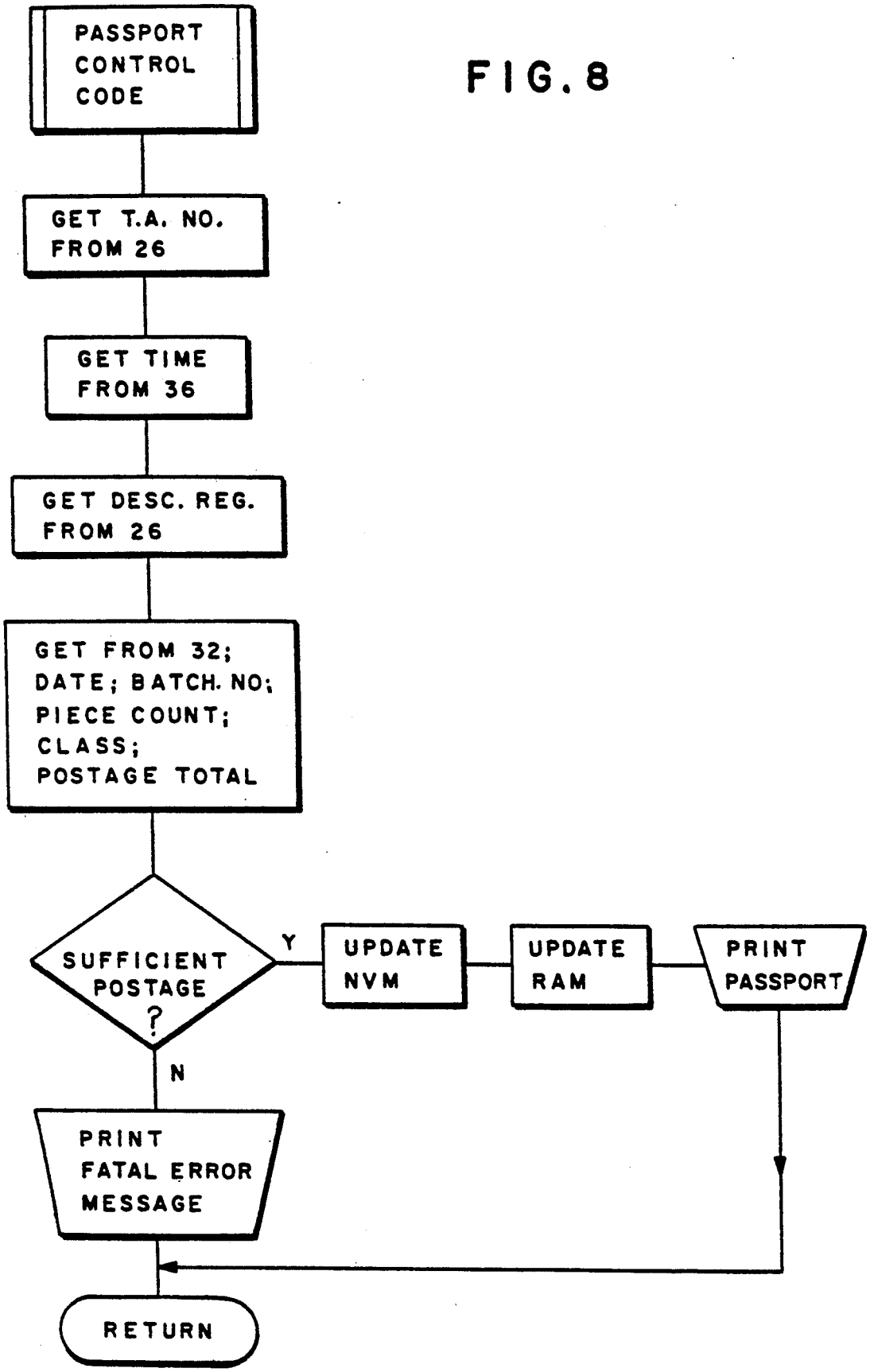

In operation with reference to FIGS. 6–8, the user at the user location 16 will be a sender of mail who will be given an identification number by the central station 14 that will be placed in the NVM 26 of the server 25. It will be appreciated that a server 25 has many characteristics of a postage meter, i.e., security, a descending register and the like, but certain elements are absent. The most evident absent element is a printer as a part thereof, the advantage of which will become evident. Following installation of the identification number, the user will communicate with the central station 14 through the telephone 30 for the purpose of indicating to the central station 14 the amount of postage value it wishes to have accredited to its memory 26. An access code will be given to the user that can be addressed to the setting device 23. Upon the receipt of the access code, the user will transmit to the central station 14 the access code and his identification number and the request for an amount of postage value. The setting device 23 will function to charge, or increase, the postage value into the memory 26. This memory 26 will include a descending register that is charged by the central station 14 with the selected amount of postage value. As the user location 16 processes mail, the postage value in the descending register will be decreased in accordance with the postage required to process the mail pieces.

The balance of the server 25 includes the ROM 34 that contains information that formats address signals and stores a series of programs for controlling the functions of the server 25, a RAM 32 that will hold and supply real time data, and a clock 36 that will provide the time and date.

It will be appreciated that the printer 40 may be capable of variable speed, be inexpensive, and be unsecured such as a ink jet printer or laser printer or any type of dot matrix printer that will apply the addresses of the addressee and addressor to the mail pieces under command of the input/processor 38. In addition, other information can be printed by the printer 40 under command of the input/processor 38 including the message the mailer wishes to send to the mail recipient. Further information may include a transaction number (T.A. No.), the run of the particular batch of mail, the date and time of mailing, the class of mail and a batch number. The transaction number is that number assigned to the user location 16 by the central station 14 every time postage value is added to the server 25 and will be stored in the NVM 26. This transaction number will be the same for one or more batches of mail that are sent and will remain the same until such time as the descending register of the NVM 26 is recharged with postage value, at that time a new transaction number will be assigned and stored in the NVM 26 in place of the preceding transaction number. By changing the transaction number upon each recharge, an element is provided for verifying postage. The batch number is one assigned by the user through the input/processor 38 whereby a given batch of mail, i.e., mail of a particular type or character, will be identified by a number assigned by the user. In addition, a run number, that is a subset of the batch, may be given to identified particular segments of the batch.

When a batch of mail is to be sent, the user will exchange mailing and postage information through between the server and the input/processor 38. This information would include the number of mail pieces to be processed and number of inserts to be printed. The input/processor 38 will then command the printer 40 to print the appropriate message on a mail piece as well as the postage, time, date, and address for a particular run. This run will be given a number that is associated with the particular mail to be sent, which number will be printed on the mail pieces of that run. As the printer prints the appropriate information upon each mail piece, the number of mail pieces and amount of postage applied will be loaded into the processor 24. At the end of the run or batch, the printer 40 will print authorization information upon a passport 46.

Figure 2:
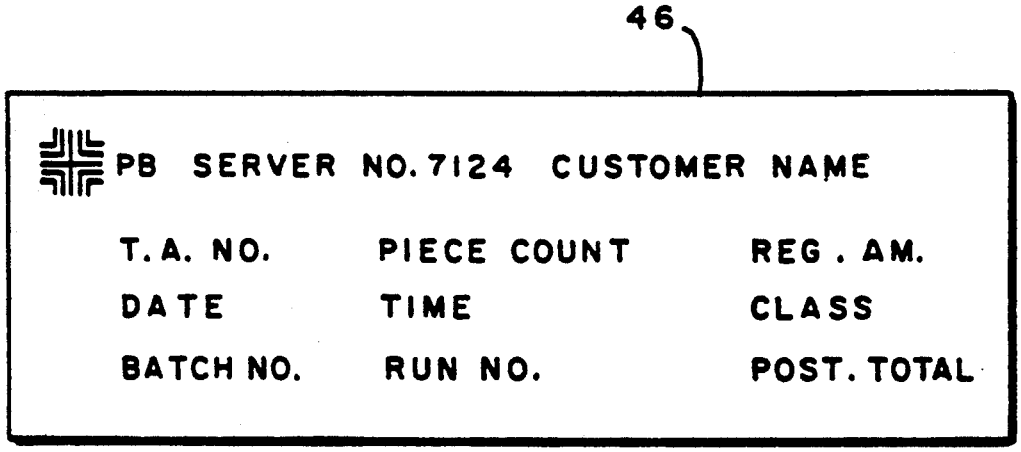
FIG. 2 is a plan view of an accounting statement that would accompany batch mail sent by the system of FIG. 1.

Referring now to FIG. 2, the passport 46 is shown after having printed thereon the total postage (Post. Total) required to mail the batch of mail, the transaction number (T.A. No.), piece count for a batch, descending register amount (Reg. Am.) after subtraction for the postage, the date, the time, the class, the batch number and the run number (optionally). Additionally, the server number, i.e., the identification number stored in the NVM 26, user name and any desired graphics can be printed. This information on the passport 46 serves several purposes. Firstly, the register amount acts as a physical record of the postage value stored in the descending register of the NVM 26. This amount is printed on the passport 46 near the upper right hand corner. The register amount will be that amount in the descending register after all postal charges have been made for the batch of mail to be sent. By placing this register amount on the passport 46 after the mailing of each batch, an ongoing, permanent record is maintained of the amount of postage value contained within the NVM 26. In this way, if there is a disaster wherein the server 25 is destroyed or the memory 26 therein is inadvertently erased, the user will still have a means for verifying the amount of postage value remaining and thus be able to recover funds. The transaction number provides an authorization check as does the identification or server number. By changing the transaction number with each recharge of the server 25, one can readily determine if more postage accompanies a transaction number than is authorized. Also printed on the passport 46 will be the date and time the passport 46 is printed, the piece count, i.e., the number of mail pieces mailed in the particular batch, and the class, or classes of mail. Upon the printing of the information on the passport 46, the postage amount for the batch will be subtracted from postage value stored in the descending register of the NVM 26. Optionally, the postage value subtraction may be done on a per piece basis.

The information printed upon the passport 46 is transmitted to the central station 14 through the communication line 28 automatically after each batch is processed, or periodically, so that a record is maintained through the processor 18 that communicates with memory 22. The memory 22 has an ascending register therein that corresponds to the descending register in the server 25, i.e., one is the inverse of the other. As is known, an ascending register is one that accumulates charges over a long term. Optionally, the memory 22 may have a descending register that duplicates the amounts in the descending register in the NVM 26 on an ongoing basis. By having the postage value contained within the memory 22 that corresponds to the value of the server 25, a check is constantly available to ensure that there is a correspondence between the passport 46 information and the amount of postage paid by the user. More specifically, the total amount credited to the user location 16 will be stored in memory 22 and if the amount in the ascending register exceeds that total amount available to the user, the user location 16 will be notified that there are insufficient funds. When a batch of mail is sent to a post office for processing, the passport 46 for that particular batch will accompany the mail. The postal employee can determine whether it is an authorized transmission of mail from the information contained upon the accompanying passport 46. If there is any question on the part of the postal service as to whether the information is authentic, it will contact the central station 14 and through the line 19 obtain sufficient information to verify the information contained on the passport 46. If this information is accurate, then the postal service will know that the mail is authorized, i.e., the postage for the mail has been paid. On the other hand, if there is any discrepancy, the postal service is able to act to ferret any fraud or correct any discrepancy. As is the usual practice in the user of postage meters, a user location 16 will send all its mail to an assigned post office.

In this way what is provided is a method of allowing a mail user to send mail without having to frank every piece. In addition, the postal service is saved the problem of requiring on-site inspections at the user location 16 in order to verify that no unauthorized mail is being sent. By correlating the amount of postage, the transaction number, piece count, registration amount and the like, verification can be made. The central station 14 more or less acts as a bank representing the postal service and handles the funds on its behalf as well as maintains records for verification. The funds or postage value charged to the server 25 may be either pre-paid or charged to the user by the central station 14 on a credit arrangement. The central station 14 would be accountable to the postal service for the postage value placed in the server on a immediate basis.

Another advantage of this system is that the printer 40 that prints the mail pieces is not part of a secure member, i.e., the server 25, as in the case of a postage meter. Because of this, the printer 40 may be replaced frequently without the expense or inconvenience of entire replacement of the entire accounting unit.

Figure 3:
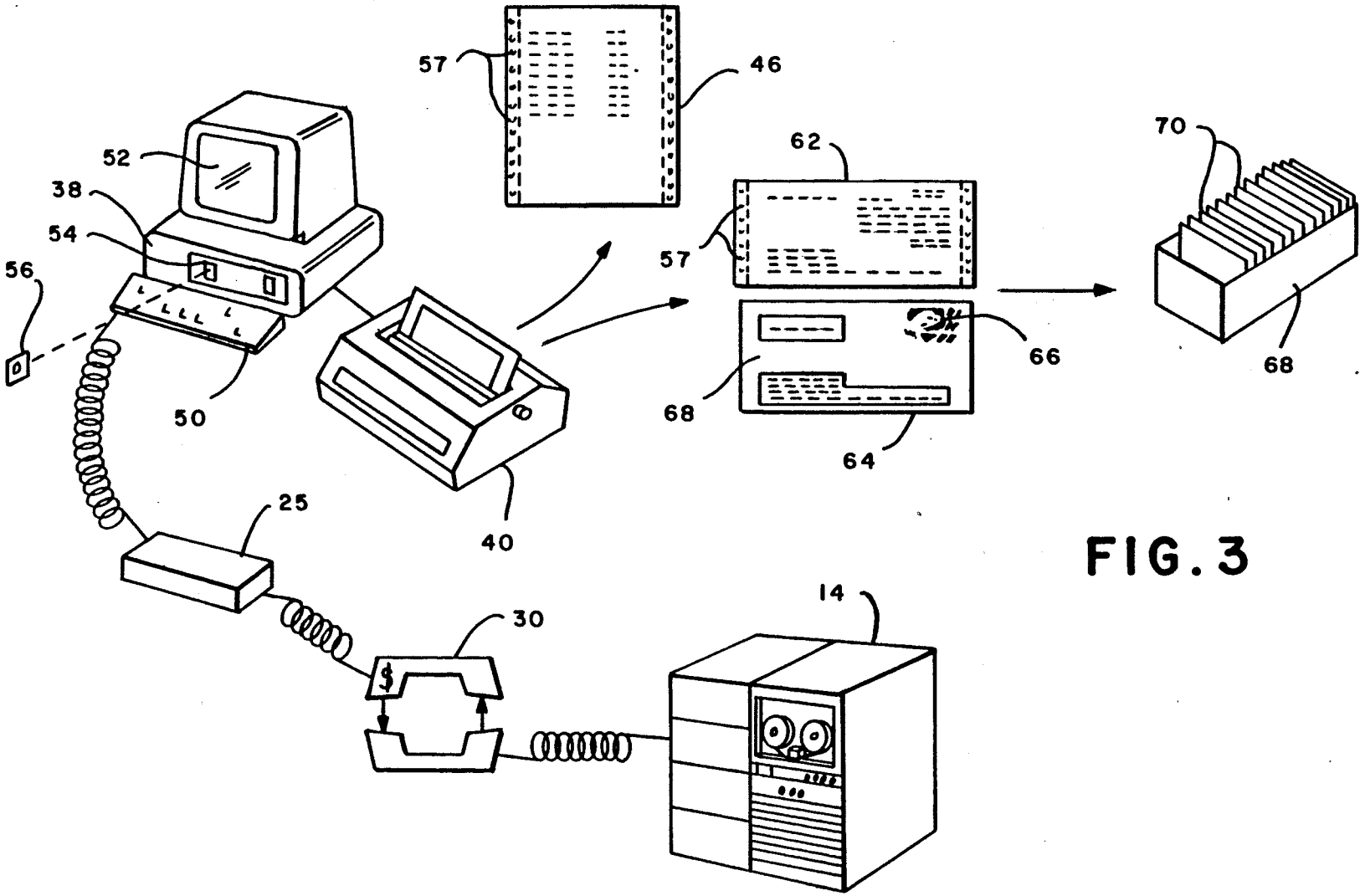
FIG. 3 is a schematic view of a preferred batch mailing system.
Figure 4:
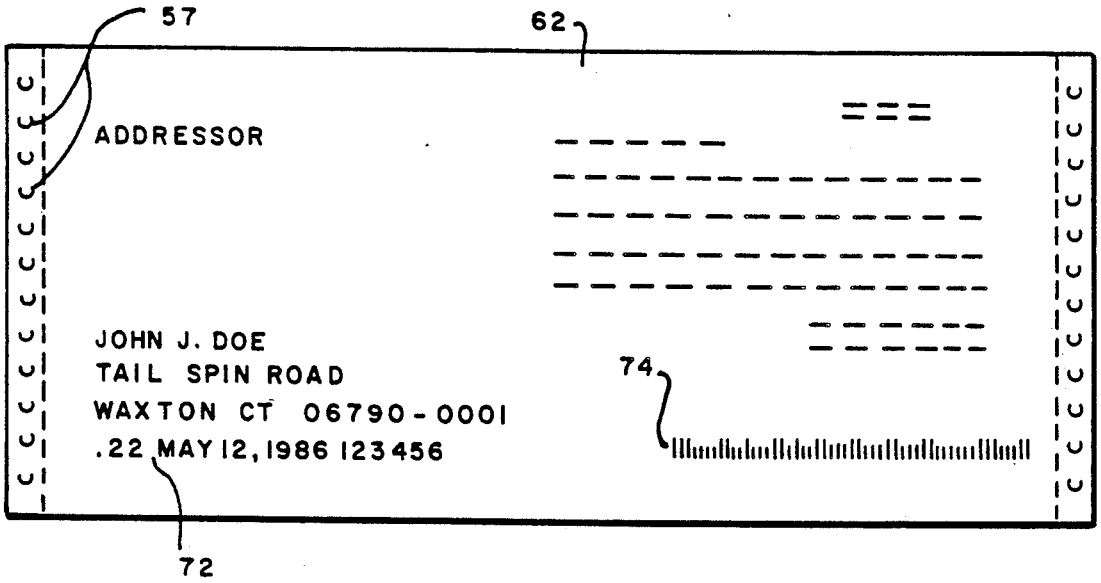
FIG. 4 is a plan view of an insert to be placed in an envelope containing information that would be applied thereto by the system of FIGS. 1 and 3.
Figure 5:
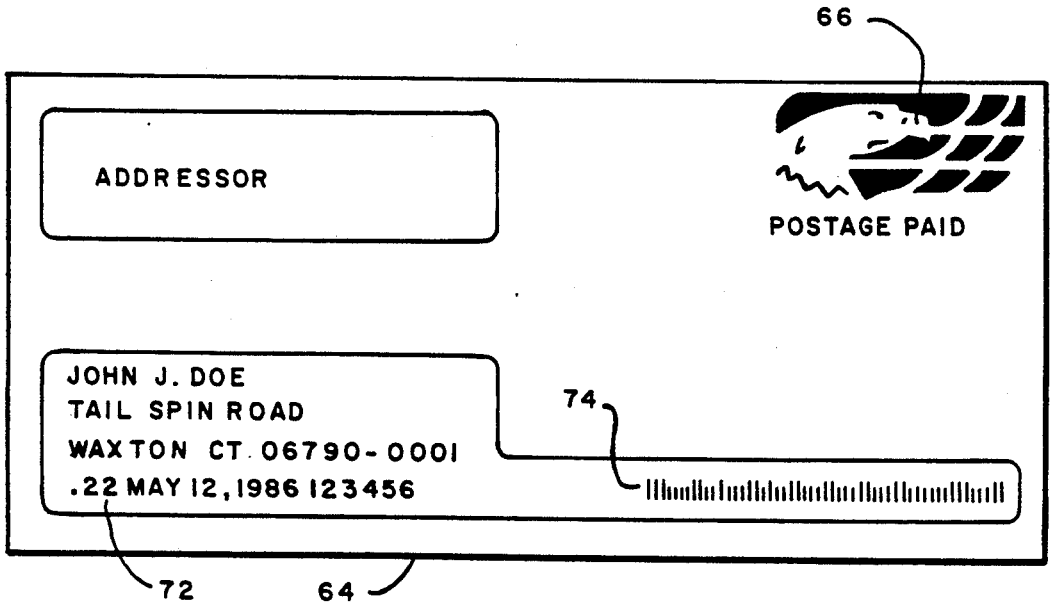
FIG. 5 is a plan view of a windowed envelope with an insert.

Referring now to FIGS. 3-5, another preferred embodiment, as it would be practiced by a small volume mail user, will be described. The server 25 is in communication with a central station 14 through a telephone 30. The server 25 is in communication with the input/-processor 38. In this particular embodiment the input/-processor 38 will be a personal computer such as an IBM AT personal computer available from IBM Corporation, Armonk, New York. The personal computer has a keyboard 50, a CRT 52 and drive and reading receptacle 54 for receiving disks 56. The input/processor 38 is connected to a printer 40 of the type that is normally connected to a computer and is able to print upon computer paper having openings along the edges thereof. The printer 40 will print two different types of documents. The first document will be an insert 62 that is receivable within a windowed envelope 64. The windowed envelope 64 will have an indicia 66 on the face thereof, this indicia indicating that postage is paid. Upon the insert 62 being placed into the windowed envelope 64 to form a mail piece 70, a number of these mail pieces will be processed and placed into a tray 68. In addition, the printer 40 will print the passport 46 that will contain the information required to verify the authenticity of the mail pieces 70.

With reference to FIG. 4, details of the insert 62 will be given. The printer 40 will print both mailing information and postage information upon the insert 62. By mailing information is meant that information concerning mail delivery and return address data for the benefit of the post office. Postage information is that information regarding payment for the mailing of the mail piece. The first line 72 of the address block contains the postage information. There the figure 0.22 is given to show the postage amount for the mail piece 70, the next gives the date, in this particular case May 12, 1986, which is the date the mail piece 70 is sent to the post office and the next number is a transaction number. In addition, the printer 40 prints the postal bar code 74 on the insert for the benefit of the post office. This results in a lower cost to the mail sender when printed in appropriate quantities.

In operation the mail user will obtain postage value from the central station 14, this postage value being stored in the memory 26 of the server 25. The personal computer 38 will then be operated to control the printer 40 for the purpose of printing the inserts 62 and passport 46. Input into the computer 38 may be either through the keyboard 50 or through a disk 56. Initially the insert 62 will be printed with the information shown in FIG. 4. As indicated previously, this information includes the destination address, as well as a postage data address. The insert 62 will be placed into the envelope 64 thereby completing a mail piece 42 in such a way that the information in seen through the window of the windowed envelope. Upon completion of the run of mail pieces 70 for that day, a summary of the transaction will be printed upon the passport 46 and the information transferred to the server 25. This passport 46 will take basically the same form as that shown in FIG. 2 wherein all the data is summarized. Upon completion of the printing of the passport 46, it will be placed with the mail pieces 70 and sent therewith to the post office. With this same information loaded into the server 25, the post office will be able to authenticate the mail.

What is claimed is:

1. A system for processing mail and for supplying a statement sheet containing mailing information that can be used to verify the mail, comprising:

a central station having a first processor and a first memory in communication with said first processor;

a user location having an accounting unit including a second processor and a second memory in communication with said second processor, said second memory storing mailing information relative to the mail to be processed;

a communication link between said central station and said user location;

a printer in communication with said second processor and having means for printing upon mail piece inserts and a statement sheet;

means for inputting individual postage amount for the processed mail into said second processor, whereby said printer prints said individual postage amount and individual mailing information upon each of said mail piece inserts under control of said second processor, and said second processor having means for determining the amount of postage required to mail processed mail, whereby the determined amount is printed upon said statement sheet by said printer under control of said second processor.

2. The system of claim 1 further comprises:

means for adjusting a postal value by said determined amount, said postal value being stored in said second memory of said accounting unit.

3. The system of claim 2 further comprises:

a descending register, said descending register being within said second memory and having said postal value stored therein.

4. The system of claim 3 further comprises:

means, in selective communication with said second processor and remote therefrom, for adjusting the postage value in said descending register.

5. The system of claim 1 wherein said second memory includes memory means that is insertable and removable from said second processor, said memory means containing said mailing information relative to the mail to be processed.

6. The system of claim 1 including means for communicating said amount of postage required to mail said plurality of mail pieces to said central station.

7. A method of processing mail and for providing the mail with a statement sheet containing information that is used to verify the mail, said method comprising the steps of:

inputting mailing information into a processor;

printing postage and mailing information upon a plurality of inserts;

placing at least one insert into each of a plurality of envelopes to produce a plurality of mail pieces;

determining number of mail pieces and the amount of postage required to mail the mail pieces; and printing the number of said mail pieces and the determined amount of postage upon a statement sheet.

8. The method of claim 7 further including the step of delivering the mail pieces and statement sheet to a post office.

9. The method of claim 7 further including the step of printing a line indicating postage on each insert.

10. The method of claim 7 further including the step of printing a postal bar code at the same horizontal level as the postage indicating line.

11. The method of claim 7 wherein said selecting windowed envelopes and placing step includes:

placing at least one insert into each of a plurality of windowed envelopes.

* * * * *